United States Patent [19]

Sartor

[11] Patent Number: 4,922,633

[45] Date of Patent: May 8, 1990

[54] SKI BOOT, PARTICULARLY OF THE REAR-ENTRY TYPE, WITH SECURING AND ADJUSTMENT DEVICE

[75] Inventor: Mariano Sartor, Montebelluna, Italy

[73] Assignee: Nordica S.p.A., Montebelluna, Italy

[21] Appl. No.: 208,613

[22] Filed: Jun. 20, 1988

[30] Foreign Application Priority Data

Jun. 23, 1987 [IT] Italy ..... 84948 A/87
Jul. 24, 1987 [IT] Italy ..... 82572 A/87

[51] Int. Cl.[5] ..... A43B 5/04; A43C 11/00

[52] U.S. Cl. ..... 36/117; 36/50; 36/120

[58] Field of Search ..... 36/117–121, 36/105, 50; 24/68 SK

[56] References Cited

U.S. PATENT DOCUMENTS

| | | | |
|---|---|---|---|
| 4,620,379 | 11/1986 | Sartor | 36/119 |
| 4,694,592 | 9/1987 | Baggio et al. | 36/117 |
| 4,769,929 | 9/1988 | Sartor | 36/119 |
| 4,785,555 | 11/1988 | Sartor | 36/119 |
| 4,823,484 | 4/1989 | Couty | 36/117 |

FOREIGN PATENT DOCUMENTS

| | | | |
|---|---|---|---|
| 0205127 | 12/1988 | European Pat. Off. | 36/117 |
| 284978 | 10/1989 | European Pat. Off. | 36/117 |
| 2522968 | 1/1977 | Fed. Rep. of Germany | 36/117 |
| 3506056 | 3/1986 | Fed. Rep. of Germany . | |
| 2450575 | 10/1980 | France | 36/117 |
| 2475372 | 8/1981 | France | 36/117 |
| 2536955 | 6/1984 | France . | |
| 2553267 | 4/1985 | France . | |

*Primary Examiner*—James Kee Chi
*Attorney, Agent, or Firm*—Guido Modiano; Albert Josif

[57] ABSTRACT

The ski boot comprises a shell with which a front quarter and a rear quarter are associated. The boot comprises at least one flexible traction element, constituted by a cable, which is connected to tensioning means which are associable with the rear quarter. The traction element engages with a coupling element which is arranged laterally to the boot and is interconnected between the shell and the front quarter. The shell or the front quarter, or possibly both, have a guiding opening for sliding engagement with said coupling element.

16 Claims, 4 Drawing Sheets

SKI BOOT, PARTICULARLY OF THE REAR-ENTRY TYPE, WITH SECURING AND ADJUSTMENT DEVICE

BACKGROUND OF THE INVENTION

The present invention relates to a ski boot, particularly of the rear-entry type, with securing and adjustment device.

As is known, various types of ski boots are currently available on the market which have devices for adjusting the degree of mutual securing of the quarters as required.

Among these, the U.S. Pat. Application No. 07/078,986 in the name of the same Assignee, discloses a ski boot which has an adjustment device constituted by a rod-like element pivoted to the shell proximate to the tip region of the boot and embraces the rear quarter.

The rear quarter is transversely and rearwardly provided with a set of teeth which allows to engage a pawl connected to the rod-like element.

This device allows an optimum degree of adjustment of the closure of the quarters, but its structural complexity is considerable and it furthermore forces the alteration of the typical configuration of the boot.

Furthermore, the rod-like element also has the function of containment of the lateral splayings of the front quarter, but requires special study to prevent wear in the lateral regions of the front quarter, where friction against the rod-like element may occur.

Other known solutions, such as for example the one described in the published French patent application No. 2553267, provide a lever element, associated at the rear quarter, which actuates a cable which joins the two quarters and is firmly connected to the shell after affecting the presser.

This solution has the disadvantage that the exerted locking force changes as the inclination of the quarters varies with respect to the shell and, furthermore, since the cable laterally affects the foot instep presser, it may cause discomfort to the user's foot and furthermore not exert a uniform securing action.

A similar solution is illustrated in the published French patent application No. 2536965, wherein a cable is provided which embraces the quarters and can be actuated by means of a laterally arranged lever. The cable symmetrically engages the lateral edges of the presser, thus contributing to the uniform distribution of the tension on the presser, but even in this case a variation of the inclination of the quarters with respect to the shell causes a change in the closure characteristics.

The published German patent application No. 3506056 discloses a ski boot wherein a securing device mutually connects the quarters, while a further element acts on the foot instep and requires an adjustment which is independent from the one which performs the closure of said quarters.

SUMMARY OF THE INVENTION

The aim of the present invention is indeed to eliminate the above described disadvantages by providing a ski boot which allows to achieve both the optimum securing between the quarters of a ski boot and a good adjustment of this securing action.

Within the scope of the above described aim, a particular object of the invention is to provide a ski boot which does not modify its quarter securing characteristics as the inclination of the quarters varies with respect to the shell.

Still another object of the present invention is to provide a ski boot wherein it is possible to achieve the simultaneous securing of one or more elements or pressers internal to the boot, together with the mutual securing of the quarters.

A further object of the present invention is to provide a ski boot for which it is not necessary to alter the conventional aesthetic lines of the boot, furthermore having the possibility of achieving a good containment of the lateral splayings of the front quarter.

Not least object of the present invention is to provide a ski boot wherein the executed adjustments can be maintained even when the boot is opened for walking.

The above described aim, as well as the mentioned objects and others which will become apparent hereinafter, are achieved by a ski boot particularly of the rear-entry type with securing and adjustment device, comprising a shell with which a front quarter and a rear quarter are associated, characterized in that it comprises at least one flexible traction element connected to tensioning means associable with said rear quarter, said at least one traction element engaging with at least one coupling element interconnected between said shell and said front quarter, said coupling element being slideably engaged in a guiding opening.

BRIEF DESCRIPTION OF THE DRAWINGS

Further characteristics and advantages of the invention will become apparent from the description of some preferred but not exclusive embodiments of a ski boot, particularly of the rear-entry type, with securing and adjustment device, illustrated only by way of non-limitative example in the accompanying drawings, wherein.

DESCRIPTION OF THE PREFERRED EMBODIMENTS

Figure 1:
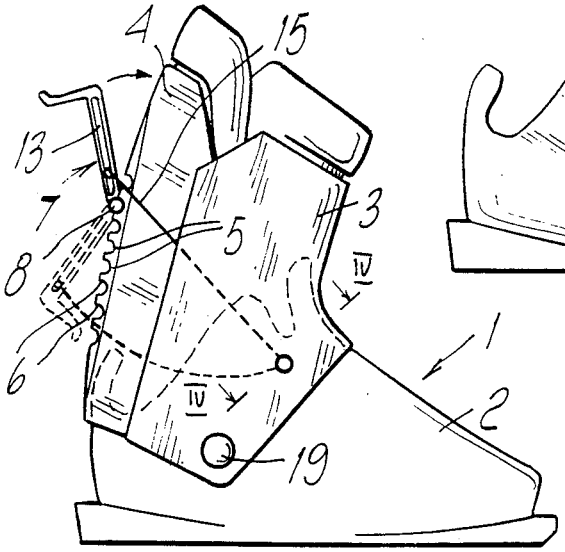
FIG. 1 is a schematic lateral elevation view of the ski boot in a first embodiment.

With reference to the above described figures, and in particular to FIGS. 1 to 6, it is illustrated a rear entry ski boot, generally indicated by the reference numeral 1 and comprising a shell 2 to which a front quarter 3 and a rear quarter 4 are pivoted.

A set of teeth is provided on the rear longitudinal edge of the rear quarter 4 and is constituted by a plurality of continuous or discontinuous seats 5 with essentially circular cross section which have substantially elastically deformable end edges 6 having an interspace, i.e. an open region for each seat, which is slightly smaller than the diameter of the seats themselves.

Tensioning means, advantageously constituted by a lever generally indicated by the reference numeral 7, engage with the seats 5.

The lever 7 has, at one end, a transverse pivot 8, shaped complementarily to the seats, so that said pivot 8 can be inserted in the selected seats 5, accordingly varying the position of the tensioning means with respect to the quarter.

The body 9 of the lever 7 defines an opening 10 longitudinally whereto there is a threaded stem 11 which is rotatably supported by the lever body 9 and extends substantially perpendicular with respect to the extension of the transverse pivot 8.

A small cylinder or transverse member 12 is slideably associated transversely to the threaded stem 11 and its ends laterally protrude from the body 9 of the lever 7 by means of slots 13 having a longitudinal extension which is at least equal to that of the opening 10.

The position of the cylinder 12 with respect to the stem 11 is presettable by means of a nut 14 complementarily threaded to the stem 11.

The ends of a flexible traction element, which is advantageously constituted by a cable 15, are associated with the ends of the cylinder 12 which protrude from the slots 13.

At its other end the cable 15 is fixed to a coupling element.

Figure 5:
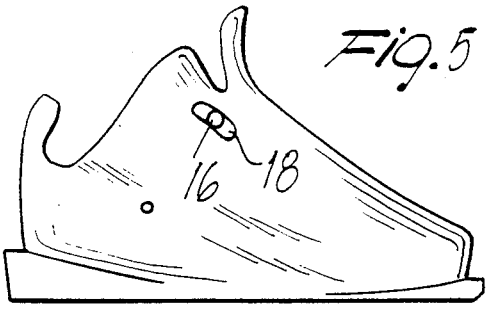
FIG. 5 is a view of a shell with the guiding opening provided on the shell.
Figure 3:
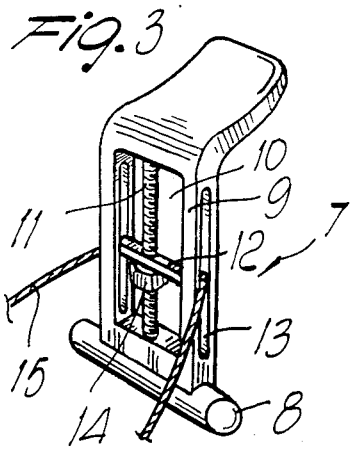
FIG. 3 is a perspective view of a possible embodiment of the tensioning means.
Figure 4:
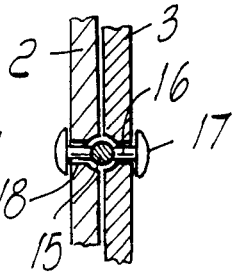
FIG. 4 is a sectional view along the line IV—IV of FIG. 1.

According to the ski boot illustrated in FIG. 5, the coupling element comprises the stem 16 of a rivet 17 which is pivoted to the front quarter 3 and is freely slideable within an arc-like guide 18 provided correspondingly in the shell.

Said arc-like guide 18 is constituted by a slot 18, which is advantageously in the shape of an arc of a circle having its center at the stud 19 for the mutual pivoting of the front quarter 3 and the shell 2.

The presence of the arc-like guide allows the sliding of the rivet 17 during the forward flexing phase while skiing without thereby varying the securing action between the front quarter and the rear quarter.

Figure 6:
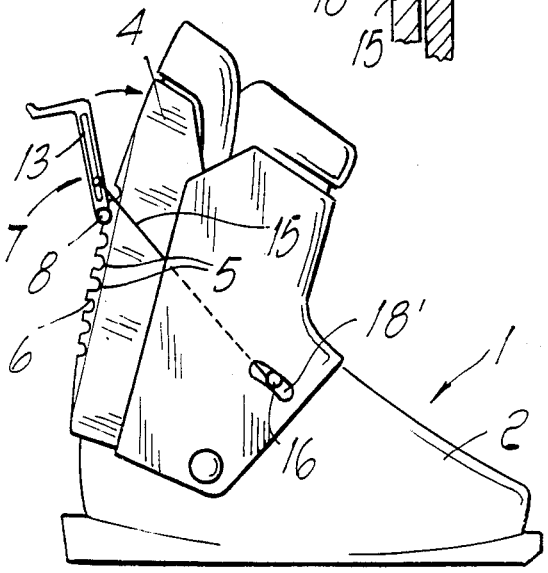
FIG. 6 is a view of a ski boot with the guiding opening provided on the front quarter.
Figure 2:
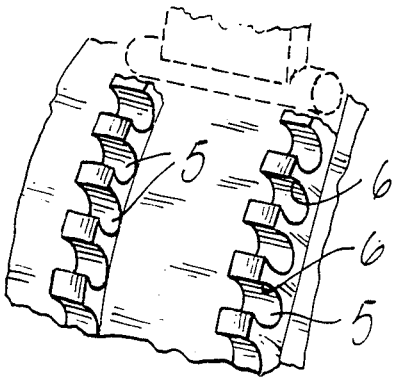
FIG. 2 is a schematic view of the coupling region of the tensioning means to the rear quarter.
Figure 7:
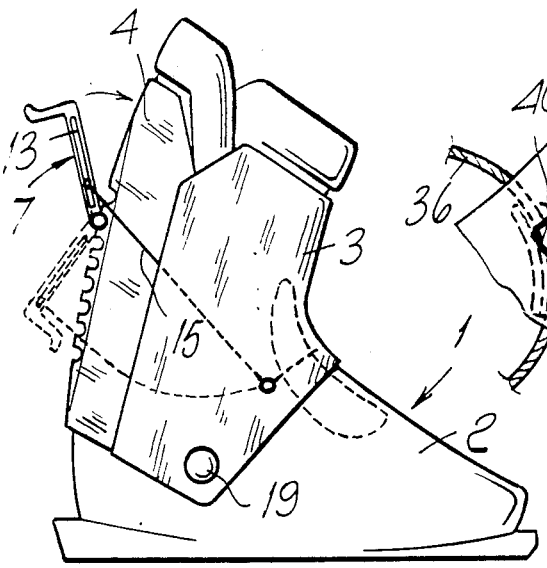
FIG. 7 is a view of a different embodiment of the ski boot with the traction element engaging a foot instep presser.
Figure 13:
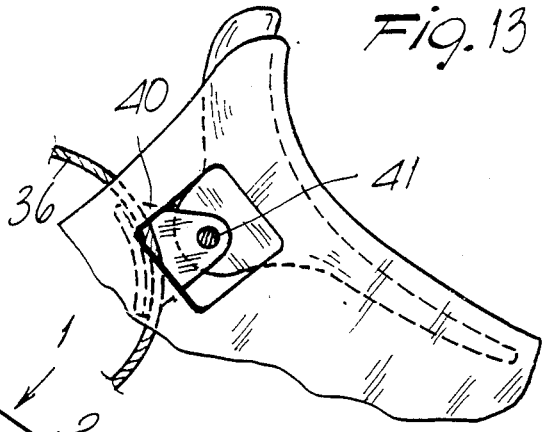
FIG. 13 is a schematic view of the detail of the coupling of the traction element to the coupling element.
Figure 9:
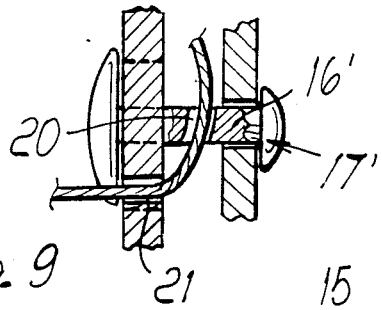
FIG. 9 is a sectional view of the portion of engagement between the flexible traction element and the coupling element.
Figure 8:
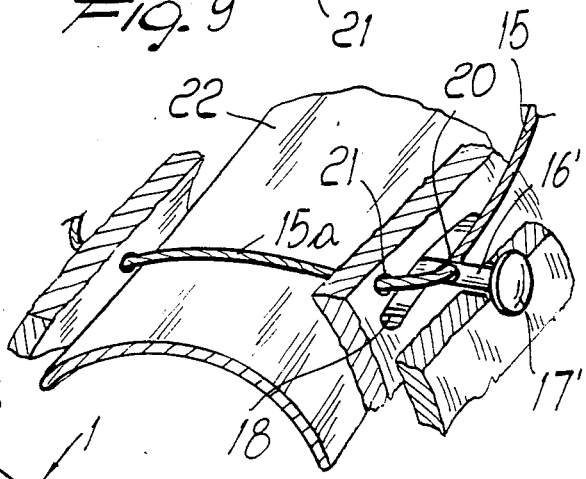
FIG. 8 is a schematic perspective view of the flexible traction element engaged at the foot instep presser.
Figure 10:
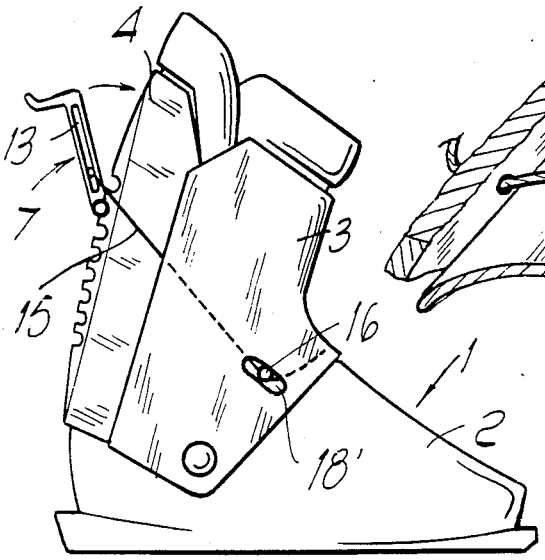
FIG. 10 is a schematic view of the ski boot with the guiding opening provided on the front quarter.
Figure 12:
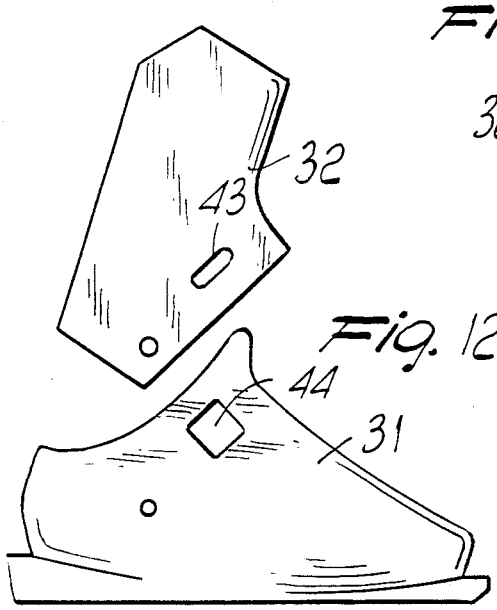
FIG. 12 is an exploded view of the shell and of the quarter of the ski boot.

According to the embodiment of FIG. 6, the conceptual arrangement remains the same, the only variation residing in the fact that the rivet 17 is pivoted to the shell 2, while it is freely slideable in a slot, now indicated at 18', which is correspondingly provided on the front quarter.

In practical use, the skier arranges the pivot 8 of the lever 7 within the selected seat 5, employing the snap-together insertion of the pivot 8 by virtue of the presence of the perimetral edges 6 which delimit an opening of the seats 5 which is smaller than the size of the pivot 8.

By rotating the lever 7 upwards, the cable 15 is tensioned and arranges itself according to the position of the cylinder 12 which abuts on the nut 14 associated with the threaded stem 11.

The nut thus has the function of allowing a micrometric adjustment of the position of the cylinder 12 and consequently offers the possibility of performing a precision adjustment of the tension of the cable 15.

As the cylinder 12 can slide freely on the stem 11, when the lever is opened the cylinder 12 moves towards the end opposite to the pivoting one, thus achieving the simple and rapid opening of the quarters.

With reference to FIGS. 7 to 10, a different embodiment of the boot is shown which is conceptually related to the previously described one; the similar elements having the same function are thus again indicated by the previously mentioned numerals.

The difference with respect to the above described embodiment resides in the fact that the cable 15 engages a transverse through channel 20 which is defined in the stem 16' of a rivet 17' which is similar to the preceding one and mutually joins the quarter and the shell with a pivoting action on the front quarter 2 and a slideable engagement in a slot 18 of the shell or, possibly, with a pivoting action on the shell and a slideable engagement in an arc-like slot 18' of the quarter.

The cable 15 which passes through the channel 20 enters a through hole 21 defined by the shell at its lateral regions and is transversely engaged above a presser 22 which is arranged at the skier's foot instep.

In this embodiment, as in the previously described one, by tensioning the cable 15 the securing of the quarters is obtained, and the securing of the foot instep is furthermore achieved, since the cable 15, with its portion 15a arranged above the presser, is substantially straightened to define a chord between the holes 21 provided on the shell, thus affecting a limited region of the presser 22.

This arrangement ensures that the presser is kept in lowered position and, as the cable does not embrace the foot, lateral tensions are not applied to the foot of the skier, allowing to considerably increase the comfort of the skier.

The securing of the foot is fully assigned to the presser 22 which is advantageously provided in rigid material.

In this embodiment, as in the embodiment illustrated in FIGS. 1 to 5, the cable 15 preferably extends on the outer surface of the rear quarter and is caused to pass internally to the front quarter 3, remaining outside the shell, except for a possible portion 15*a* which is internal to the shell above the presser.

With reference to FIGS. 11 to 17, a different embodiment of a rear-entry ski boot, generally indicated by the reference numeral 30, is illustrated; in this embodiment a front quarter 32 and a rear quarter 33 are pivoted to a shell 31.

A lever 35 is connected to the rear quarter 33 in a manner similar to what has been previously described and actuates a cable 36 which constitutes the flexible traction element and initially extends towards the lower portion of the rear quarter and enters lower lateral holes 37 to pass inside the rear quarter in the region comprised between the rear quarter and the shell, where a linkage transmission is provided for the cable, which extends on a return saddle, indicated at 40, which is connected to a coupling element constituted by a coupling pivot 41 which is pivoted, at its inner end, to a lateral portion of a foot instep presser, indicated at 42.

The fixing pivot 41 slideably engages with an elongated slot 43, provided on the front quarter, and in a widened opening 44 which is provided on the shell.

A covering stud 45, having such dimensions as to close the elongated slot 43 for any position of the pivot 41 in said elongated slot 43, is connected to the end of the fixing pivot 41.

Figure 14:
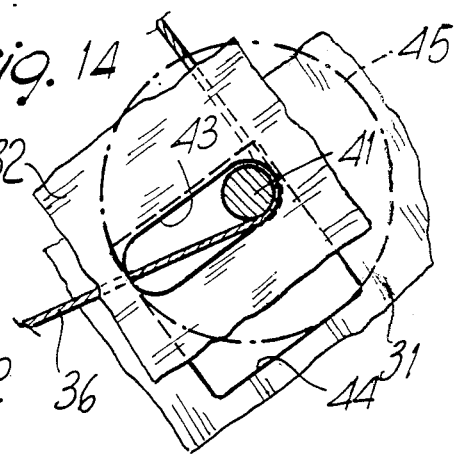
FIGS. 14, 15 and 16 are schematic views of the different arrangement, in the various operating positions, of the coupling element with respect to guiding openings provided both on the quarter and on the shell.
Figure 15:
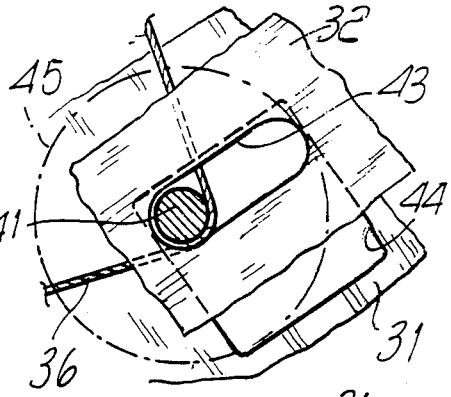
Figure 11:
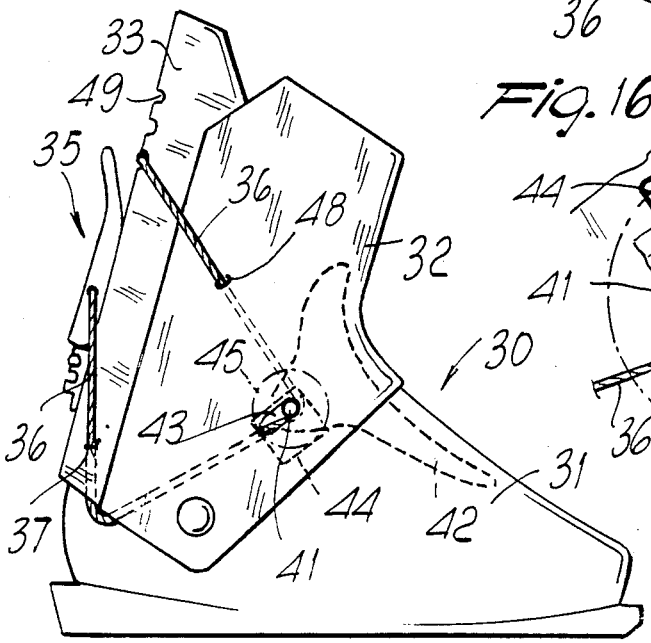
FIG. 11 is a view of a different embodiment of the ski boot.
Figure 16:
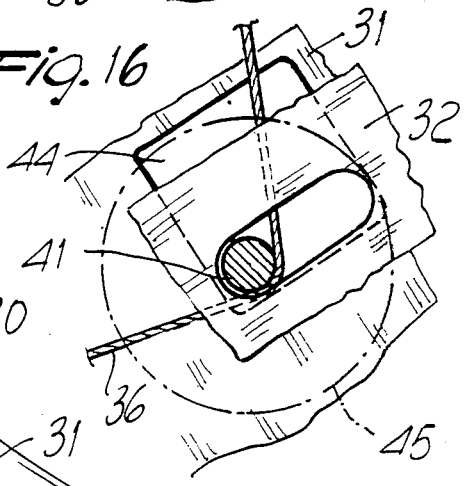
Figure 17:
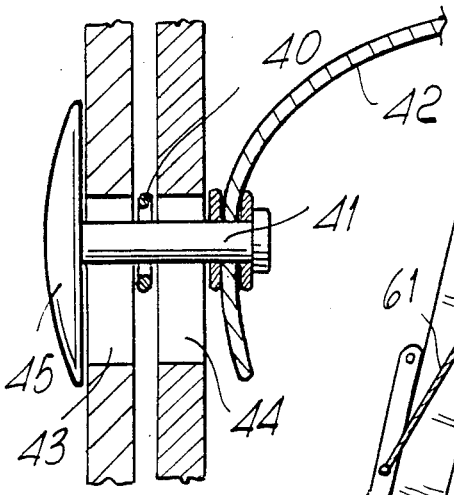
FIG. 17 is a view of the connection, in the boot illustrated in FIG. 11, between the coupling element and the shell, the front quarter and the presser.

As is more clearly illustrated in the FIGS. 14, 15 and 16, wherein for the sake of simplicity of illustration the cable 36 is caused to extend directly on the pivot 41 instead of on the saddle 40, the elongated slot 43 has a substantially rectilinear shape with an inclined arrangement having its lower end directed towards the heel region, while the widened opening 44 has an essentially rhomboidal configuration with sides arranged parallel and perpendicular to the slot 43.

With this arrangement, when the boot is open the fixing pivot 41 arranges itself at the upper end of the slot 43 as illustrated in FIG. 14, while when the boot is closed it arranges itself proximate to the lower end (FIG. 15).

During the oscillation of the quarters with respect to the shell, the pivot 41 can move in the widened opening 44, as schematically illustrated in FIG. 16, without varying the securing action which is exerted between the quarters.

The rotation of the front quarter during the flexing which occurs while skiing is allowed by the presence of the widened opening 44, which allows the free sliding of the pivot, increasing the degree of securing of the foot due to a greater pressing force exerted on the foot instep presser.

The widened opening 44, besides limiting the forward inclination, also limits the rotation towards the rear part of the quarters, thus allowing a good rearward hold.

The cable 36, after extending on the return saddle 40, again embraces the rear quarter 33, exiting from upper holes 48 defined by the front quarter, and engages with spaced 48 defined by the front quarter, and engages with spaced notches 49 which are defined at the upper part of the rear quarter 33.

Figure 18:
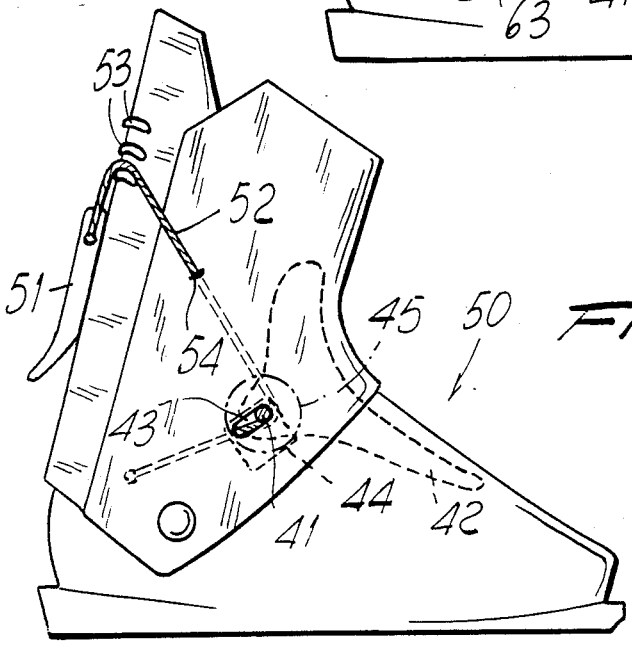
FIG. 18 is a view of a different embodiment of the ski boot.

According to the embodiment described in FIG. 18, a ski boot is provided, indicated at 50, wherein the coupling between the shell and the quarter is provided with a fixing pivot which is fully identical to the one indicated at 41 and wherein a rear lever 51 is provided, arranged on the quarter, and acts on a traction element constituted by a cable 52 which extends on raised adjustment portions 53 before being inserted beneath the front quarter by means of upper through holes 54 to extend, in the previously described manner, at the fixing pivot, again indicated at 41.

The cable 52 is fixed to a point at a lower rear portion of the front quarter, alternatively the fixed point may be provided on the shell.

Figure 19:
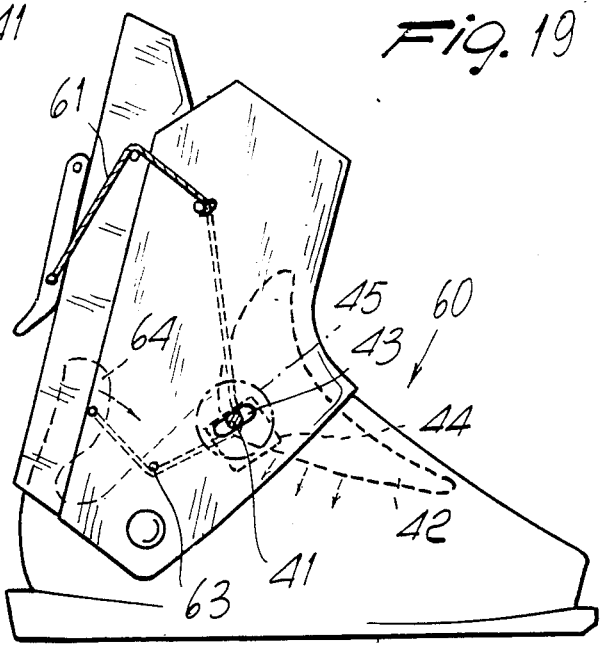
FIG. 19 is a view of a further embodiment of the ski boot.

The boot 60 illustrated in FIG. 19 has a configuration which is substantially similar to that of the boot illustrated in FIG. 18, the variation residing in the fact that the cable, now indicated at 61, extends, after passing at the fixing pivot 41, on a transmission pivot 63 and is fixed to a point on the rear flap 64 of the shell, and performs the securing also at the heel region upon the tensioning of the cable.

From what has been described above it can thus be observed that the invention achieves the intended aim and objects, and in particular the fact is stressed that a boot is provided which allows both the optimum rapid securing of the quarters and an optimum adjustment of the securing degree thereof, together with the securing of the foot inside the boot.

The securing degree set for the quarters furthermore remains unchanged during the flexing phase while skiing, since the coupling element can slide with respect to the shell.

Furthermore, once the device is opened, the selected securing degree remains unchanged, allowing the skier to pass from a condition of non-use to a securing condition in an extremely short time.

The device furthermore offers, by virtue of the presence of the cable which extends laterally to the shell, the possibility of containing the lateral splayings during the flexing phases.

The splayings of the front quarter are also reduced, since the front quarter is attached to the shell in two remote points.

The invention thus conceived is susceptible to numerous modifications and variations, all of which are within the scope of the inventive concept.

Furthermore all the details may be replaced with other technically equivalent elements.

In practice, the materials employed, so long as compatible with the specific use, as well as the contingent shapes and dimensions, may be any according to the requirements.

I claim:

1. Ski boot, particularly of the rear entry type comprising;

a shell, a front quarter associated with said shell, a rear quarter associated with said shell, at least one coupling element interconnected between said shell and said front quarter, at least one flexible traction element engaging said at least one coupling element, tensioning means connected to said traction element and being associable with said rear quarter, wherein said coupling element is slideably engaged in a guiding opening, and wherein said tensioning means comprise;

a lever having an articulation end, a plurality of seats provided rearwardly to said rear quarter, and a transverse pivot located at said articulation end of said lever and being selectively and removably associable with one of said plurality of seats provided on said at least one quarter.

2. Ski boot according to claim 1, wherein said seats are elastically yieldable, wherein said rear quarter has a rear edge, and wherein said seats are defined by a set of teeth, said transverse pivot defining a diameter, said teeth being provided on said rear edge of said rear quarter and having perimetral edges, said perimetral edges delimiting said seats and defining mutual distances, each of said mutual distances defining a seat opening and being smaller then said diameter of said transverse pivot.

3. Ski boot according to claim 1, wherein said lever comprises;

a body, a longitudinal opening defined in said body,
a longitudinally extending stem rotatably supported in said longitudinal opening,
a transverse member slideably and transversely associated with said stem,
elongate slots defined on said lever, and
ends defined by said transverse member and protruding laterally from said lever through said elongate slots,
wherein said traction element has traction element ends, said traction element ends being associated with said ends of said transverse member.

4. Ski boot according to claim 1, wherein said lever comprises;
a body,
a longitudinal opening defined in said body,
a longitudinally extending threaded stem rotatably supported in said longitudinal opening,
a transverse member slideably and transversely associated with said stem,
elongate slots defined on said lever, and
ends defined by said transverse member and protruding laterally from said lever through said elongate slots,
wherein said traction element has traction element ends, said traction element ends being associated with said ends of said transverse member, and
wherein said lever further comprises a threaded nut, said threaded nut engaging said longitudinally extending threaded stem, for permitting micrometric positioning of said transverse member.

5. Ski boot comprising;
a shell,
at lest one quarter associated with said shell,
at least one other quarter associated with said shell,
tensioning means associable with said at least one quarter, and
at least one flexible traction element connected to said at least one other quarter and to said tensioning means, wherein said tensioning means comprise;
at least one lever having at least one articulation end,
a plurality of seats provided on said at least one quarter,
at least one transverse pivot located at said articulation end of said lever and being selectively and removably associable with one of said plurality of seats provided on said at least one quarter.

6. Ski boot according to claim 5, wherein said traction element is connected to said at least one other quarter via at least one connection element, wherein said at least one quarter is constituted by a rear quarter, and wherein said at least one other quarter is constituted by a front quarter, said coupling element being interconnected between said shell and said front quarter.

7. Ski boot according to claim 6, further comprising guide means formed on said shell, said coupling element being connected to said front quarter and slideably engagaging said guide means.

8. Ski boot according to claim 5, wherein said seats are elastically yieldable, wherein said at least one quarter has at least one edge, and wherein said seats are defined by a set of teeth, said transverse pivot defining a diameter, said teeth being provided on said edge of said at least one quarter and having perimetral edges, said perimetral edges delimiting said seats and defining mutual distances, each of said mutual distances defining a seat opening, said seat opening being smaller than said diameter of said transverse pivot.

9. Ski boot according to claim 5, wherein said lever comprises;
at least one body,
at least one opening defined in said body,
at least one longitudinal stem rotatably supported in said opening,
at least one transverse member slideably and transversely associated with said stem,
a plurality of elongate slots defined on said lever, and
ends defined by said transverse member and protruding laterally from said lever through said elongate slots,
wherein said traction element has traction element ends, said traction element ends being associated with said ends of said transverse member.

10. Ski boot according to claim 5, wherein said lever comprises;
at least one body,
at least one opening defined in said body,
at least one longitudinal stem rotatably supported in said opening,
at least one transverse member slideably and transversely associated with said stem,
a plurality of elongate slots defined on said lever, and
ends defined by said transverse member and protruding laterally from said lever through said elongate slots,
wherein said traction element has traction element ends, said traction element ends being associated with said ends of said transverse member, and wherein said lever further comprises a threaded nut, said threaded nut engaging said longitudinally extending threaded stem, for permitting micrometric positioning of said transverse member.

11. In a ski boot comprising;
a shell,
a least one quarter associated with said shell,
at least one other quarter associated with said shell, and
at least one flexible traction element connected to said at least one other quarter,
a traction element tensioning device comprising;
at least one tensioning lever connected to said traction element,
at least one articulation end defined by said tensioning lever, and
accommodation means rigidly associated with said at least one quarter,
wherein said articulation end of said tensioning lever is selectively and removably associable with said accommodation means provided on said at least one quarter.

12. A traction element tensioning device according to claim 11, wherein said accommodation means comprise a plurality of seats, said plurality of seats being provided on said at least one quarter, and wherein said articulation end of said lever is selectively and removably associable with at least one seat among said plurality of seats.

13. A traction element tensioning device according to claim 11, wherein said accommodation means comprise a plurality of seats, said plurality of seats being provided on said at least one quarter, wherein said articulation end of said lever is selectively and removably associable with at least one seat among said plurality of seats, and wherein said articulation end of said tensioning lever is constituted by at least one transverse pivot, said transverse pivot being selectively removably accommodatable in at least one seat among said plurality of seats thereby selectively and removably associating said said articulation end of said lever with said at least one seat.

14. A traction element tensioning device according to claim 13, wherein said seats are elastically yieldable and are defined by a set of teeth, said transverse pivot defining a diameter, said teeth having perimetral edges, said perimetral edges delimiting said seats and defining mutual distances, each of said mutual distances defining a seat opening, said seat opening being smaller than said diameter of said transverse pivot.

15. A traction element tensioning device according to claim 11, wherein said lever comprises;

at least one body, at least one opening defined in said body, at least one longitudinal stem rotatably supported in said opening, at least one transverse member slideably and transversely associated with said stem, a plurality of elongate slots defined on said lever, and ends defined by said transverse member and protruding laterally from said lever through said elongate slots, wherein said traction element has traction element ends, said traction element ends being associated with said ends of said transverse member.

16. A traction element tensioning device according to claim 15, wherein said lever further comprises a threaded nut, said threaded nut engaging said longitudinally extending threaded stem, for permitting micrometric positioning of said transverse member with respect to said longitudinal stem.

* * * * *